US007291432B2

(12) United States Patent
Lin et al.

(10) Patent No.: US 7,291,432 B2
(45) Date of Patent: Nov. 6, 2007

(54) IMAGING MEMBERS

(75) Inventors: Liang-Bih Lin, Webster, NY (US); Surendar Jevadev, Rochester, NY (US); Markus R. Silvestri, Fairport, NY (US); James M. Markovics, Rochester, NY (US); Andronique Ioannidis, Webster, NY (US); Linda L. Ferrarese, Rochester, NY (US); John S. Chambers, Rochester, NY (US); Anna M. Main, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 365 days.

(21) Appl. No.: 10/807,073

(22) Filed: Mar. 23, 2004

(65) Prior Publication Data

US 2005/0214664 A1 Sep. 29, 2005

(51) Int. Cl.
*G03G 5/04* (2006.01)

(52) U.S. Cl. ..... 430/78; 430/56

(58) Field of Classification Search ..... 430/78, 430/56

See application file for complete search history.

(56) References Cited

U.S. PATENT DOCUMENTS

| | | | | |
|---|---|---|---|---|
| 4,265,990 | A | 5/1981 | Stolka et al. | 540/59 |
| 4,474,865 | A | 10/1984 | Ong et al. | 430/58 |
| 4,587,189 | A | 5/1986 | Hor et al. | 430/59 |
| 5,336,577 | A | 8/1994 | Spiewak et al. | 430/59 |
| 2003/0211413 | A1* | 11/2003 | Lin et al. | 430/78 |

OTHER PUBLICATIONS

Duff, James M. et al., U.S. Appl. No. 10/408,201 on Photoconductive Imaging Members, filed Apr. 4, 2003.

* cited by examiner

*Primary Examiner*—Mark A. Chapman
(74) *Attorney, Agent, or Firm*—Eugene O. Palazzo; Fay Sharpe LLP

(57) ABSTRACT

A photoconductive imaging member with linear and proportional collection efficiencies and substantially constant photoinduced characteristics comprised of a supporting substrate, and thereover in, for example, certain weight ratios, a single layer comprised of a mixture of a photogenerator component, a charge transport component, an electron transport component, and a polymer binder, and wherein the photogenerating component is a pigment.

29 Claims, No Drawings

IMAGING MEMBERS

CROSS-REFERENCE TO RELATED APPLICATIONS

Illustrated in related copending application U.S. Ser. No. 10/408,201, the disclosure of which is totally incorporated herein by reference, is, for example, a photoconductive imaging member comprised of a supporting substrate, a hole blocking layer thereover, a photogenerating layer, and a charge transport layer, and wherein the hole blocking layer is comprised of a metallic component and an electron transport component.

The appropriate components and processes of the above copending application may be selected for the invention of the present application in embodiments thereof.

BACKGROUND

This invention relates in general to electrophotographic imaging members and, more specifically, to positively or negatively charged electrophotographic imaging members having a single electrophotographic photoconductive insulating layer and processes for forming images on the member. More specifically, the present invention in embodiments relates to a single layered photoconductive imaging member containing a charge generation layer or photogenerating layer comprised, for example, of a metal free phthalocyanine component dispersed in a matrix of a hole transporting and an electron transporting binder in, for example, certain ratio amounts and in embodiments a second or top charge, especially hole transport layer. The electrophotographic imaging member single layer components, which can be dispersed in various suitable resin binders, can be of various thicknesses, however, in embodiments a thick layer, such as from about 5 to about 60, and more specifically from about 10 to about 40 microns, is selected. This layer can be considered a dual function layer since it can generate charge and transport charge over a wide distance, such as a distance of at least about 50 microns. Furthermore, there is provided in accordance with embodiments of the present invention linear and proportional filed dependent organic photoreceptors, and which members enable, for example, excellent image quality, substantially constant photoinduced discharge characteristics (PIDC), and thus minimal or substantially no variation in image quality; stable photoreceptors resulting, for example, from the use of photogenerating layers that possess linear and proportional field dependent collection efficiencies (CE), where the collection efficiency refers, for example, to the ratio of number of separated electron-hole pairs to the number of imaging photons; and prolonged photoreceptor wear properties.

REFERENCES

A number of electrophotographic imaging members are multilayered imaging members comprising a substrate and a plurality of other layers such as a charge generating layer and a charge transport layer. These multilayered imaging members also often contain a charge blocking layer and an adhesive layer between the substrate and the charge generating layer. Further, an anti-plywooding layer may be included in the member, which can be a separate layer or be part of the dual function layer. An example of a dual function layer for preventing plywooding is a charge blocking layer or an adhesive layer which also prevents plywooding. The expression "plywooding" refers in embodiments to the formation of unwanted patterns in electrostatic latent images caused by multiple reflections during laser exposure of a charged imaging member. When developed, these patterns resemble plywood. These multilayered imaging members are also costly and time consuming to fabricate because of the many layers that must be formed. Further, complex equipment and valuable factory floor space are required to manufacture these multilayered imaging members. In addition to presenting plywooding problems, the multilayered imaging members often encounter charge spreading which degrades image resolution.

Another problem encountered with multilayered photoreceptors comprising a charge generating layer and a charge transport layer is that the thickness of the charge transport layer, which is normally the outermost layer, tends to become thinner due to wear during image cycling. The change in thickness causes changes in the photoelectrical properties of the photoreceptor. Thus, usually to maintain image quality, complex and sophisticated electronic equipment and software management are usually necessary in the imaging machine to compensate for the photoelectrical changes, which can increase the complexity of the machine, cost of the machine, size of the footprint occupied by the machine, and the like. Without proper compensation of the changing electrical properties of the photoreceptor during cycling, the quality of the images formed can degrade because of spreading of the charge pattern on the surface of the imaging member and a decline in image resolution. High quality images can be important for digital copiers, duplicators, printers, and facsimile machines, particularly laser exposure machines that demand high resolution images. Moreover, the use of lasers to expose conventional multilayered photoreceptors can lead to the formation of undesirable plywood patterns that are visible in the final images.

The fabrication of electrophotographic imaging members comprising a substrate and a single electrophotographic photoconductive insulating layer in place of a plurality of layers, such as a charge generating layer and a charge transport layer, is known. However, in formulating single electrophotographic photoconductive insulating layer photoreceptors many problems need to be overcome including charge acceptance for hole and/or electron transporting materials from photoelectroactive pigments. In addition to electrical compatibility and performance, a material mix for forming a single layer photoreceptor should possess the proper rheology and resistance to agglomeration to enable acceptable coatings. Also, compatibility among pigment, hole and electron transport molecules, and film forming binder is desirable. As utilized herein, the expression "single electrophotographic photoconductive insulating layer" refers in embodiments to a single electrophotographically active photogenerating layer capable of retaining an electrostatic charge in the dark during electrostatic charging, imagewise exposure and image development. Thus, unlike a single electrophotographic photoconductive insulating layer photoreceptor, a multilayered photoreceptor has at least two electrophotographically active layers, namely at least one charge generating layer and at least one separate charge transport layer.

U.S. Pat. No. 4,265,990, the disclosure of which is totally incorporated herein by reference, discloses a photosensitive member having at least two electrically operative layers. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula. This structure may be imaged in the conventional xerographic mode which usually includes charging, exposure to light and development.

U.S. Pat. No. 5,336,577, the disclosure of which is totally incorporated herein by reference, disclosing a thick organic ambipolar layer on a photoresponsive device is simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment or dye may also be included.

SUMMARY

It is, therefore, a feature of the present invention to provide electrophotographic imaging members comprising a single electrophotographic photoconductive insulating layer.

It is another feature of the present invention to provide an improved electrophotographic imaging member comprised of a single electrophotographic photoconductive insulating layer that avoids plywooding problems, and which layer contains, in certain ratios by weight, a photogenerating pigment, an electron transport component, a hole transport component, and a film forming binder, and which members possess linear and a proportional field dependant collection efficiency (CE) when subjected to light of a wavelength of from about 350 to about 950 nanometers. The linear dependency refers, for example, to the relationship $CE=\alpha*E+\beta$, where CE is the collection efficiency, E is the electric field strength, and wherein $\alpha$ and $\beta$ are known constants depending on the imaging member. More specifically, the field strength E can vary to from about 1 to about 40 V/μm, the proportional dependency refers, for example, to the relationship $CE=\alpha*E$, where CE is the collection efficiency, E is the electric field strength, and $\alpha$ is a constant.

It is another feature of the present invention to provide an improved imaging member comprised of a single electrophotographic photoconductive insulating layer that possesses a linear and proportional collection efficiency at a xerographic process speed of about 40 to about 400 m/sec and at a dark decay of about 1 to about 2,000 V/s.

It is still another feature of the present invention to provide an improved imaging member comprising a single electrophotographic photoconductive insulating layer that eliminates the need for a charge blocking layer between a supporting substrate and the electrophotographic photoconductive insulating layer, and wherein the photogenerating mixture layer can be of a thickness of, for example, from about 5 to about 60 microns, and thereover as the top layer a charge transporting layer, and which members possess excellent high photosensitivities, acceptable discharge characteristics, prolonged wear characteristics, and further which members are visible and infrared laser compatible.

It is yet another feature of the present invention to provide an electrophotographic imaging member comprising a single electrophotographic photoconductive insulating layer which can be fabricated with fewer coating steps at reduced cost.

It is another feature of the present invention to provide an electrophotographic imaging member comprising a single electrophotographic photoconductive insulating layer which eliminates charge spreading, therefore, enabling higher image resolution, and which members are not substantially susceptible to plywooding effects, light refraction problems, and thus with the photoconductive imaging members of the present invention in embodiments thereof an undercoated separate layer is avoided.

It is yet another feature of the present invention to provide an improved electrophotographic imaging member comprising a single electrophotographic photoconductive insulating layer which has excellent cycling and stability characteristics, and which members possess high resolution since, for example, the image forming charge packet does not need to traverse the entire thickness of the member and thus does not spread, and further with such single layered members there is enabled in embodiments extended life since, for example, the layer can be present in a thicker, such as from about 5 to about 60 microns, layer as compared to a number of multilayered devices wherein the thickness of the photogenerator layer is usually about 1 to about 3 microns in thickness and the charge transport layer is usually about 10 to about 30 microns in thickness, thus with the aforementioned invention devices there is substantially no image resolution loss and substantially no image resolution loss with wear.

It yet another feature of the present invention to provide an improved electrophotographic imaging member comprising a single electrophotographic photoconductive insulating layer for which PIDC curves do not substantially change with time or repeated use, and also wherein with these photoreceptors charge injections from the substrate to the photogene rating pigment is reduced and thus a charge blocking layer can be avoided.

It is still another feature of the present invention to provide an improved electrophotographic imaging member comprising a single electrophotographic photoconductive insulating layer which is ambipolar and can be operated at either positive (the preferred mode) or negative biases.

The present invention in embodiments thereof is directed to a photoconductive imaging member comprised of a supporting substrate, a single layer thereover comprised of a mixture of a photogenerating pigment or pigments, a hole transport component or components, an electron transport component or components, and a film forming binder. More specifically, the present invention relates to an imaging member with a thick, such as for example, from about 5 to about 60, and more specifically, from about 12 to about 35 microns, single active layer comprised of a mixture of photogenerating pigments, hole transport molecules, electron transport compounds, and a filming forming binder.

Aspects of the present invention are directed to an imaging member possessing a collection efficiency proportional to an electric field, and which member is comprised of a single layer containing a photogenerating component and a mixture of a charge transport component and a polymeric binder, and wherein the charge transport component is comprised of a mixture of hole transport and electron transport components; a photoconductive imaging member comprised of a supporting substrate, and thereover a single layer comprised of a mixture of a photogenerator component, a hole transport component, an electron transport component, and a polymer binder, and optionally wherein the photogenerating component is a metal free phthalocyanine, and wherein the weight ratio of photogenerating component to binder, hole transport and electron transport components is from about 1:99 to about 2:98, and the weight ratio of the binder component to the hole and electron transport component is from about 40:60 to about 60:40, and the weight ratio of the hole transport component to the electron transport component is from about 70:30 to about 50:50; photoconductive imaging member comprised of a first layer mixture containing a photogenerating component, hole transport molecules and an electron transport component, and thereover and in contact with said first layer a second layer comprised of hole transport molecules dispersed in a resin binder; a photoconductive imaging member comprised of a supporting substrate, and thereover a single layer comprised of a mixture of a photogenerator component, a charge transport component, an electron transport component, and a polymer binder, and wherein the weight ratio of photogenerating component/binder/charge transport/electron transport component is from about 1:45:25:15 to about 1:55:35:18; a photoconductive imaging member comprised, in certain weight ratios and in sequence of a substrate, a single electrophotographic photoconductive insulating layer, the electrophotographic photoconductive insulating layer comprising photogenerating particles comprising photogenerating pigments, such as metal free phthalocyanines, dispersed in a matrix comprising charge, and more specifically hole transport molecules, such as, for example, those selected from the group consisting of an arylamine and a hydrazone, an electron transport or transporter selected, for example, from the group consisting of a carboxylfluorenone malonitrile (CFM) and derivatives thereof; derivative refers, for example, to a chemical analogue, for example a molecule that belongs to the same group as the represented one but with some variation(s) in the side groups, such as differences in $R_{1-8}$ in the chemical structure

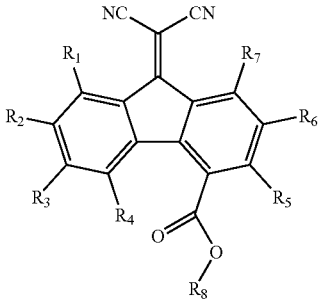

wherein each R is independently selected from the group consisting of hydrogen, alkyl such as these with, for example, from about 1 to about 40 carbon atoms, alkoxy from, for example, about 1 to about 40 carbon atoms, phenyl, substituted phenyl, higher aromatic such as naphthalene and anthracene, alkylphenyl from, for example, about 6 to about 40 carbons, alkoxyphenyl from, for example, about 6 to about 40 carbons, aryl from, for example, about 6 to about 30 carbons, substituted aryl from, for example, about 6 to 30 about carbons and halogen; a nitrated fluorenone derivative

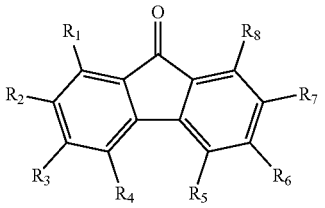

wherein each R is independently selected from the group consisting of hydrogen, alkyl with, for example, from about 1 to about 40 carbon atoms, alkoxy with, for example, from about 1 to about 40 carbon atoms; aryl, such as phenyl, substituted phenyl; higher aromatics such as naphthalene and anthracene, alkylphenyl with, for example, from about 6 to about 40 carbons, alkoxyphenyl with, for example, from about 6 to about 40 carbon atoms; aryl with, for example, from about 6 to about 30 carbon atoms, substituted aryl with, for example, from about 6 to about 30 carbon atoms and halogen, and wherein at least two R groups are nitro; a N,N'-bis(dialkyl)-1,4,5,8-naphthalenetetracarboxylic diimide derivative or N,N'-bis(diaryl)-1,4,5,8-naphthalenetetracarboxylic diimide derivative represented by

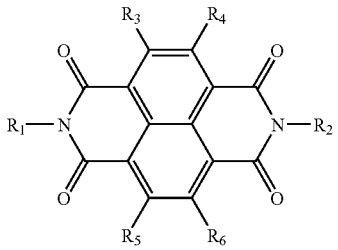

wherein $R_1$ is substituted or unsubstituted alkyl, branched alkyl, cycloalkyl, alkoxy or aryl, such as phenyl, naphthyl, or a higher polycyclic aromatic such as anthracene; $R_2$ is alkyl, branched alkyl, cycloalkyl, or aryl, such as phenyl, naphthyl, or a higher polycyclic aromatic such as anthracene or the same as $R_1$; $R_1$ and $R_2$ can independently contain from about 1 to about 50 and, more specifically, from about 1 to about 12 carbon atoms; $R_3$, $R_4$, $R_5$ and $R_6$ are alkyl, branched alkyl, cycloalkyl, alkoxy or aryl, such as phenyl, naphthyl, or a higher polycyclic aromatic such as anthracene or halogen, and the like; $R_3$, $R_4$, $R_5$ and $R_6$ can be the same or different; when $R_3$, $R_4$, $R_5$ and $R_6$ are each carbon, they can contain from about 1 to about 50, or from about 1 to about 12 carbon atoms; a 1,1'-dioxo-2-(aryl)-6-phenyl-4-(dicyanomethylidene) thiopyran derivative represented by the general formula

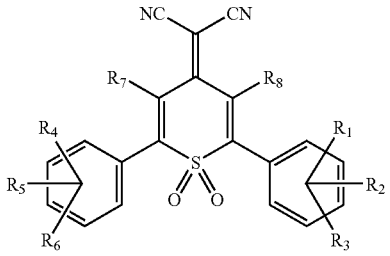

wherein each R is independently selected from the group consisting of hydrogen, alkyl from, for example, about 1 to about 40 carbon atoms, alkoxy from, for example, about 1 to about 40 carbon atoms, phenyl, substituted phenyl, higher aromatic such as naphthalene and anthracene, alkylphenyl from, for example, about 6 to about 40 carbon atoms, alkoxyphenyl from, for example, about 6 to about 40 carbon atoms, aryl from, for example, about 6 to about 30 carbon atoms, substituted aryl from, for example, about 6 to about 30 carbon atoms and halogen; a carboxybenzyl naphthaquinone derivative represented by

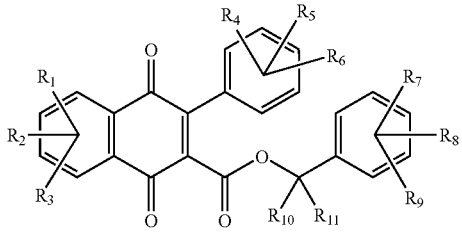

and/or

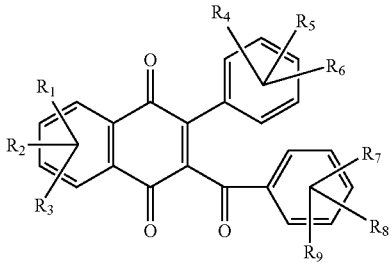

wherein each R is independently selected from the group consisting of hydrogen, alkyl from, for example, about 1 to about 40 carbon atoms, alkoxy from, for example, about 1 to about 40 carbon atoms, phenyl, substituted phenyl, higher aromatic such as naphthalene and anthracene, alkylphenyl from, for example, about 6 to about 40 carbon atoms, alkoxyphenyl from, for example, about 6 to about 40 carbon atoms, aryl from, for example, about 6 to about 30 carbon atoms, substituted aryl from, for example, about 6 to about 30 carbon atoms and halogen; or a diphenoquinone represented by

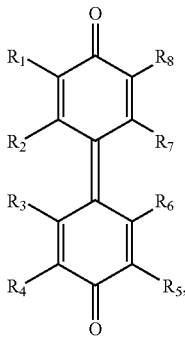

and mixtures thereof, wherein each R is independently selected from the group consisting of hydrogen, alkyl from, for example, about 1 to about 40 carbon atoms, alkoxy from, for example, about 1 to about 40 carbon atoms, phenyl, substituted phenyl, higher aromatic such as naphthalene and anthracene, alkylphenyl from, for example, about 6 to about 40 carbon atoms, alkoxyphenyl from, for example, about 6 to about 40 carbon atoms, aryl from, for example, about 6 to about 30 carbon atoms, substituted aryl from, for example, about 6 to about 30 carbon atoms and halogen, and oligomeric and polymeric derivatives wherein the above moieties or groups represent part of the oligomer or polymer repeat units, and mixtures thereof, and a film forming binder, for example, selected from the group consisting of polycarbonates, polyesters, polystyrenes, and the like; a member wherein the single layer is of a thickness of from about 10 to about 50 microns; a member wherein the amounts for each of the components in the single layer mixture is from about 0.05 weight percent to about 30 weight percent for the photogenerating component, from about 15 weight percent to about 70 weight percent for the hole transport component, and from about 10 weight percent to about 70 weight percent of the electron transport component, and wherein the total of the components is about 100 percent, and wherein the layer is dispersed in from about 15 weight percent to about 75 weight percent of a polymer binder; a member wherein the amounts for each of the single layer components is from about 0.5 weight percent to about 5 weight percent for the photogenerating component, from about 30 weight percent to about 50 weight percent for the charge transport component, and from about 5 weight percent to about 30 weight percent for the electron transport component, and which components are contained in from about 30 weight percent to about 50 weight percent of a polymer binder; a member wherein the thickness of the single photogenerating layer mixture is from about 10 to about 40 microns; a member wherein the single layer components are contained in a binder, and wherein the charge transport is comprised of hole transport molecules; a member wherein the binder is present in an amount of from about 40 to about 90 percent by weight, and wherein the total of all components of the photogenerating component, the hole transport component, the binder, and the electron transport component is about 100 percent; a member wherein the metal free phthalocyanine photogenerating pigment absorbs light of a wavelength of from about 550 to about 950 nanometers; an imaging member wherein the supporting substrate is comprised of a suitable metal; an imaging member wherein the substrate is aluminum, aluminized polyethylene terephthalate or titanized polyethylene terephthalate; an imaging member wherein the binder for the single photogenerating mixture layer and for the top charge transport layer when present is selected from the group consisting of polyesters, polyvinyl butyrals, polycarbonates, polystyrene-b-polyvinyl pyridine, amines, such as N,N'-diphenyl-N,N'-bis(alkylphenyl)-1,1-biphenyl-4,4'-diamine; tri-p-tolylamine; N,N'-bis-(3,4-dimethylphenyl)-4-biphenyl amine; N,N'-bis-(4-methylphenyl)-N,N''-bis(4-ethylphenyl)-1,1'-3,3'-dimethylbiphenyl)-4,4'-diamine; PHN, phenanthrenediamine; polyvinyl formulas; and the like; an imaging member wherein the hole transport in the photogenerating mixture and for the charge transport top layer when present comprises aryl amine molecules; an imaging member wherein the hole transport contained in the photogenerating mixture is comprised of

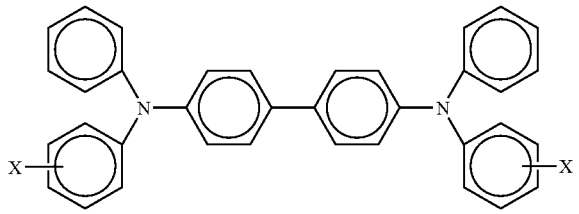

wherein X is selected from the group consisting of alkyl, alkoxy and halogen; an imaging member wherein alkyl contains from about 1 to about 10 carbon atoms, and wherein the top charge transport when present is an aryl amine encompassed by the formula, and which amine is optionally dispersed in a highly insulating and transparent resinous binder; an imaging member wherein alkyl contains from 1 to about 5 carbon atoms; an imaging member wherein alkyl is methyl, and wherein halogen is chloride; an imaging member wherein the charge transport is comprised of N,N'-diphenyl-N,N-bis(3-methyl phenyl)-1,1'-biphenyl-4,4'-diamine dispersed in a resin binder; an imaging member wherein the electron transport component is (4-n-butoxycarbonyl-9-fluorenylidene)malononitrile, 2-methylthioethyl 9-dicyanomethylene fluorene-4-carboxylate, 2-(3-thienyl) ethyl 9-dicyanomethylenefluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone; an imaging member wherein the electron transport component is (4-n-butoxycarbonyl-9-fluorenylidene)malononitrile; an imaging member wherein the electron transport component is (4-n-butoxycarbonyl-9-fluorenylidene)malononitrile, 2-methylthioethyl 9-dicyanomethylenefluorene-4-carboxylate, 2-(3-thienyl)ethyl 9-dicyanomethylene fluorene-4-carboxylate, 2-phenylthioethyl 9-dicyanomethylenefluorene-4-carboxylate, 11,11,12,12-tetracyanoanthraquino dimethane or 1,3-dimethyl-10-(dicyanomethylene)-anthrone; an imaging member wherein the photogenerating component is a metal free phthalocyanine; an imaging member wherein the photogenerating component is a metal free phthalocyanine, the electron transport is (4-n-butoxy carbonyl-9-fluorenylidene)malononitrile, and the charge transport is a hole transport of N,N'-diphenyl-N,N-bis(3-methyl phenyl)-1,1'-biphenyl-4,4'-diamine molecules; an imaging member wherein the X polymorph metal free phthalocyanine has major peaks, as measured with an X-ray diffractometer, at Bragg angles (2theta±0.2°); an imaging member wherein the photogenerating component mixture layer further contains a second photogenerating pigment; an imaging member wherein the photogenerating mixture layer further contains a perylene; an imaging member wherein the photogenerating component is comprised of a mixture of a metal free phthalocyanine, and a second photogenerating pigment; a method of imaging which comprises generating an electrostatic latent image on the imaging member of the present invention, developing the latent image, and transferring the developed electrostatic image to a suitable substrate; a method of imaging wherein the imaging member is exposed to light of a wavelength of from about 500 to about 950 nanometers; an imaging apparatus containing a charging component, a development component, a transfer component, and a fixing component, and wherein the apparatus contains a photoconductive imaging member comprised of supporting substrate, and thereover a layer comprised of a metal free phthalocyanine photogenerator component, a charge transport component, and an electron transport component; a member wherein the electron transport is (4-n-butoxycarbonyl-9-fluorenylidene)malononitrile, 2-methylthioethyl 9-dicyano methylenefluorene-4-carboxylate, 2-(3-thienyl)ethyl 9-dicyano methylenefluorene-4-carboxylate, 2-phenylthioethyl 9-dicyano methylenefluorene-4-carboxylate, 11,11,12,12-tetracyano anthraquino dimethane or 1,3-dimethyl-10-(dicyanomethylene)-anthrone, and the like; an imaging member further containing an adhesive layer and a hole blocking layer; an imaging member wherein the blocking layer is contained as a coating on a substrate, and wherein the adhesive layer is coated on the blocking layer; and photoconductive imaging members comprised of an optional supporting substrate, a single layer comprised of a photogenerating layer of a metal free phthalocyanine, and further BZP perylene, which BZP is preferably comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference, charge transport molecules, reference for example U.S. Pat. No. 4,265,990, the disclosure of which is totally incorporated herein by reference, electron transport components, and a binder polymer; preferably the charge transport molecules for the photogenerating mixture layer are aryl amines, and the electron transport is a fluorenylidene, such as (4-n-butoxycarbonyl-9-fluorenylidene)malononitrile, reference U.S. Pat. No. 4,474,865, the disclosure of which is totally incorporated herein by reference; an imaging member comprised of supporting substrate, a single layer thereover comprised of a photogenerator layer comprised of a metal free phthalocyanine, charge transport molecules of N,N'-diphenyl-N,N'-bis(3-methylphenyl)-1,1'-biphenyl-4,4'-diamine, and an electron transport component of (4-n-butoxycarbonyl-9-fluorenylidene)malononitrile, all dispersed in a suitable polymer binder, such as a polycarbonate binder like PCZ 400, a bisphenol-Z-carbonate with an $M_w$ of about 400, and wherein the weight ratio of photogenerating component/binder/charge transport component/electron transport component is from about 1:45:25:15 to about 1:55:35:18, and yet more specifically, about 1.4:48.6:32:18, and wherein the CE is linear and proportional to the electric field at a thickness of from about 10 to about 50 microns, the CE was also linear and proportional to an applied, internal electric field of from about 400 to about 950 nanometers of exposure light; the CE is also linear and proportional to the electric field at from about 40 to about 400 mm/sec process speed and about 1 to 2,000 V/s dark decay rate, and a member wherein $CE=\alpha*E$, where CE is the collection efficiency, E is the electric field strength, and $\alpha$ is a constant. The internal electric fields in the member that span its operational range can be, for example, from about 1 to about 40 V/μm, have the CE from about zero at zero electric field to its maximum of unity at the maximum field; thus, $\alpha=0.025$ μm/V when the value of $\alpha$ is much higher, the linear range may be restricted as the CE reaches unity at fields lower than about 40 V/μm, too small a value of $\alpha$ will result in a very shallow and slow PIDC for practical values of exposure.

This imaging member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image.

Any suitable substrate may be selected for the imaging members illustrated herein. The substrate may be opaque or substantially transparent, and may comprise any suitable material having the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium and the like, or exclusively be comprised of a conductive material such as aluminum, chromium, nickel, brass and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer. Examples of substrate layers selected for the imaging members of the present invention can be as indicated herein, such as an opaque or substantially transparent material, and may comprise any suitable material having the requisite mechanical properties. Thus, the substrate may comprise a layer of insulating material including inorganic or organic polymeric materials, such as MYLAR® a commercially available polymer, MYLAR® containing titanium, or other suitable metal, a layer of an organic or inorganic material having a semiconductive surface layer, such as indium tin oxide, or aluminum arranged thereon, or a conductive material inclusive of aluminum, chromium, nickel, brass or the like. The thickness of the substrate layer as indicated herein depends on many factors, including economical considerations, thus this layer may be of substantial thickness, for example over 3,000 microns, or of a minimum thickness. In one embodiment, the thickness of this layer is from about 75 microns to about 300 microns.

Generally, the thickness of the single layer in contact with the supporting substrate depends on a number of factors, including the thickness of the substrate, and the amount of components contained in the single layer, and the like. Accordingly, the layer can be of a thickness of, for example, from about 3 microns to about 60 microns, and more specifically, from about 5 microns to about 30 microns. The maximum thickness of the layer in embodiments is dependent primarily upon factors, such as photosensitivity, electrical properties and mechanical considerations.

The binder resin present in various suitable amounts, for example from about 5 to about 70, and more specifically, from about 10 to about 50 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select as the single layer coating, solvents such as ketones, alcohols, aromatic hydrocarbons, halogenated aliphatic hydrocarbons, ethers, amines, amides, esters, and the like. Specific binder examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

An optional adhesive layer may be formed on the substrate. Typical materials employed in an undercoat adhesive layer include, for example, polyesters, polyamides, poly (vinyl butyral), poly(vinyl alcohol), polyurethane, polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometer to about 10 micrometers. A thickness of from about 0.1 micrometer to about 3 micrometers can be desirable. Optionally, the undercoat layer may contain suitable amounts of additives, for example, of from about 1 weight percent to about 10 weight percent, of conductive or nonconductive particles, such as zinc oxide, titanium dioxide, silicon nitride, carbon black, and the like, to enhance, for example, electrical and optical properties. The undercoat layer can be coated on to a supporting substrate from a suitable solvent. Typical solvents include, for example, tetrahydrofuran, dichloromethane, and the like, and mixtures thereof.

Examples of photogenerating components, especially pigments, are metal free phthalocyanines, and as an optional second pigment metal phthalocyanines, perylenes, vanadyl phthalocyanine, chloroindium phthalocyanine, and benzimidazole perylene, which is preferably a mixture of, for example, 60/40, 50/50, 40/60, bisbenzimidazo(2,1-a-1',2'-b) anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, and the like, inclusive of appropriate known photogenerating components. The photogenerating component, which is preferably comprised of a metal free phthalocyanine, is in embodiments comprised of, for example, about 50 weight percent of the metal free and about 50 weight percent of a resin binder.

Charge transport components that may be selected for the photogenerating mixture include, for example, arylamines, and more specifically, N,N'-diphenyl-N,N-bis(3-methyl phenyl)-1,1'-biphenyl-4,4'-diamine, 9-9-bis(2-cyanoethyl)-2,7-bis(phenyl-m-tolylamino)fluorene, tritolylamine, hydrazone, N,N'-bis(3,4-dimethylphenyl)-N"(1-biphenyl)amine and the like dispersed in a polycarbonate binder.

Specific examples of electron transport molecules are (4-n-butoxycarbonyl-9-fluorenylidene)malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyano methylenefluorene-4-carboxylate, 11,11,12,12-tetracyano anthraquino dimethane, 1,3-dimethyl-10-(dicyanomethylene)-anthrone, and the like.

The photogenerating pigment can be present in various amounts, such as, for example, from about 0.05 weight percent to about 30 weight percent, and more specifically, from about 0.05 weight percent to about 5 weight percent. Charge transport components, such as hole transport molecules, can be present in various effective amounts, such as in an amount of from about 10 weight percent to about 75 weight percent, and more specifically, in an amount of from about 30 weight percent to about 50 weight percent; the electron transport molecule can be present in various amounts, such as in an amount of from about 10 weight percent to about 75 weight percent, and more specifically, in an amount of from about 5 weight percent to about 30 weight percent, and the polymer binder can be present in an amount of from about 10 weight percent to about 75 weight percent, and more specifically, in an amount of from about 30 weight percent to about 50 weight percent. The thickness of the single photogenerating layer can be, for example, from about 5 microns to about 60 microns, and more specifically, from about 10 microns to about 30 microns.

The photogenerating pigment primarily functions to absorb the incident radiation and generates electrons and holes. In a negatively charged imaging member, holes are transported to the photoconductive surface to neutralize negative charge and electrons are transported to the substrate to permit photodischarge. In a positively charged imaging member, electrons are transported to the surface where they neutralize the positive charges and holes are transported to the substrate to enable photodischarge. By selecting the appropriate amounts of charge and electron transport molecules, ambipolar transport can be obtained, that is, the imaging member can be charged negatively or positively, and the member can also be photodischarged.

The photoconductive imaging members can be prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating, electron transport, and charge transport components of the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 5 to about 40 microns after drying.

Imaging members of the present invention are useful in various electrostatographic imaging and printing systems, particularly those conventionally known as xerographic processes. Specifically, the imaging members of the present invention are useful in xerographic imaging processes wherein the photogenerating component absorbs light of a wavelength of from about 550 to about 950 nanometers, and more specifically, from about 700 to about 850 nanometers. Moreover, the imaging members of the present invention can be selected for electronic printing processes with gallium arsenide diode lasers, light emitting diode (LED) arrays, which typically function at wavelengths of from about 660 to about 830 nanometers, and for color systems inclusive of color printers, such as those in communication with a computer. Thus, included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example by heat, the image thereto. In those environments wherein the member is to be used in a printing mode, the imaging method is similar with the exception that the exposure step can be accomplished with a laser device or image bar.

The electron transport as indicated herein is known and is, more specifically, a tetra(t-butyl)diphenolquinone represented by the following formula

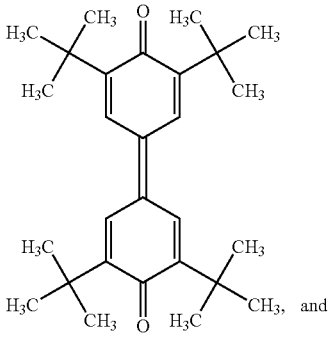

mixtures thereof, and (4-n-butoxycarbonyl-9-fluorenylidene)malononitrile of the following formulas

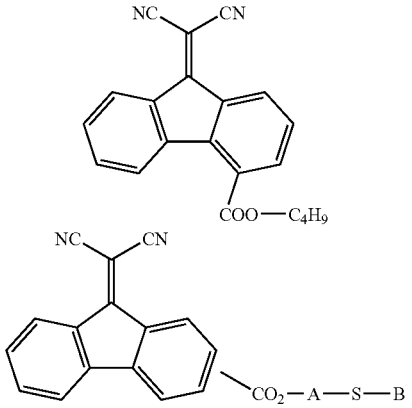

wherein S is sulfur; A is a spacer moiety or group selected from the group consisting of alkylene groups wherein alkylene can contain, for example, from about 1 to about 14 carbon atoms, and arylene groups, which can contain from about 7 to about 36 carbon atoms; and B is selected from the group consisting of alkyl groups and aryl groups. Specific examples include 2-methylthioethyl 9-dicyanomethylenefluorene-4-carboxylate, 2-(3-thienyl)ethyl 9-dicyanomethylenefluorene-4-carboxylate, a 2-phenylthioethyl 9-dicyano methylenefluorene-4-carboxylate, and the like. The electron transporting materials can contribute to the ambipolar properties of the final photoreceptor and also provide the desired rheology and freedom from agglomeration during the preparation and application of the coating dispersion. Moreover, these electron transporting materials ensure substantial discharge of the photoreceptor during imagewise exposure to form the electrostatic latent image.

Polymer binder examples include components, as illustrated, for example, in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000, and more specifically, with a molecular weight, $M_w$ of from about 50,000 to about 100,000.

The combined weight of the arylamine hole transport molecules and the electron transport molecules in the electrophotographic photoconductive insulating layer is, for example, about 35 percent and about 65 percent by weight, based on the total weight of the electrophotographic photoconductive insulating layer after drying. The polymer binder can be present in an amount of from about 10 weight percent to about 75 weight percent, and more specifically, in an amount of from about 30 weight percent to about 60 weight percent, based on the total weight of the electrophotographic photoconductive insulating layer after drying. The hole transport and electron transport molecules can be dissolved or molecularly dispersed in the film forming binder. The expression "molecularly dispersed", as employed herein, is defined as dispersed on a molecular scale. The above materials can be processed into a dispersion useful for coating by any of the conventional methods used to prepare such materials. These methods include ball milling, media milling in both vertical or horizontal bead mills, paint shaking the materials with suitable grinding media, and the like to achieve a suitable dispersion.

The following Examples are provided.

The XRPDs were determined as indicated herein, that is X-ray powder diffraction traces (XRPDs) were generated on a Philips X-Ray Powder Diffractometer Model 1710 using X-radiation of CuK-alpha wavelength (0.1542 nanometer).

EXAMPLE I

A pigment dispersion was prepared by roll milling 5 grams of x metal free phthalocyanine (x polymorph represents a crystal structure of metal free phthalocyanine, reference U.S. Pat. No. 3,932,180, the disclosure of which is totally incorporated herein by reference) pigment particles and 5 grams of poly(4,4'-diphenyl-1,1'-cyclohexane carbonate) (PCZ400, binder available from Mitsubishi Gas Chemical Company, Inc.) in 65.8 grams of tetrahydrofuran (THF) with 400 grams of 3 millimeter diameter steel balls for 24 to 72 hours.

Separately, 18.8 grams of poly(4,4'-diphenyl-1,1'-cyclohexane carbonate) were weighed together with 12.2 grams of N,N'-diphenyl-N,N'-bis(methylphenyl)-1,1-biphenyl-4,4'-diamine, 8.2 grams of N,N'-bis(1,2-dimethylpropyl)-1,4,5,8-naphthalenetetracarboxylicdiimide, 77.4 grams of THF (tetrahydrofuran) and 22.1 grams of monochlorobenzene. This mixture was rolled in a glass bottle until the solids were dissolved, then 6.65 grams of the above pigment dispersion were added to form a dispersion containing the x polymorph of metal free phthalocyanine, poly(4,4'-diphenyl-1,1'-cyclohexane carbonate), N,N'-diphenyl-N,N'-bis(methylphenyl)-1,1-biphenyl-4,4'-diamine, and N,N'-bis(1,2-dimethylpropyl)-1,4,5,8-naphthalene tetracarboxylic diimide in a solids weight ratio of (2:48:30:20) and a total solid contents of 27 percent; and rolled to mix (without milling beads). About 26 dispersions were prepared at total solids contents ranging from 25 percent to 28.5 percent. These dispersions were applied by dip coating to aluminum drums having a length of about 24 to about 36 centimeters and a diameter of 30 millimeters. For the 27 weight percent dispersion, a pull rate of 100, 120, 140, and 160 millimeters/minute provided 20, 24, 30, and 36 micrometer thick single photoconductive insulating layers on the drums after drying. The thickness of the resulting dried layers were determined by capacitive measurements and by transmission electron microscopy.

EXAMPLE II

A pigment dispersion was prepared by roll milling 6.3 grams of the x polymorph metal free phthalocyanine pigment particles and 6.3 grams of poly(4,4'-diphenyl-1,1'-cyclohexane carbonate) binder (PCZ500, available from Teijin Chemical, Ltd.) in 107.4 grams of tetrahydrofuran (THF) with several hundred, about 700 to about 800, grams of 3 millimeter diameter steel for about 24 to about 72 hours.

Separately, 31.32 grams of poly(4,4'-diphenyl-1,1'-cyclohexane carbonate) were weighed with 20.25 grams of N,N'-diphenyl-N,N'-bis(methylphenyl)-1,1-biphenyl-4,4'-diamine, 13.50 grams of N,N'-bis(1,2-dimethylpropyl)-1,4,5,8-naphthalenetetracarboxylic diimide, 165.29 grams of THF, and 46.50 grams of monochlorobenzene. This mixture was rolled in a glass bottle until the solids were dissolved; then 23.14 grams of the above pigment dispersion were added to form a dispersion containing the x polymorph of metal free phthalocyanine, poly(4,4'-diphenyl-1,1'-cyclohexane carbonate), N,N'-diphenyl-N,N'-bis(methylphenyl)-1,1-biphenyl-4,4'-diamine, and N,N'-bis(1,2-dimethylpropyl)-1,4,5,8-naphthalene tetracarboxylic diimide in a solids weight ratio of (2:48:30:20) and a total solid contents of 22.5 percent; and rolled to further mix (without milling beads). Various dispersions were prepared at total solids content ranging from 20.5 percent to 23.5 percent. These dispersions were applied by dip coating to aluminum drums having a length of about 24 to about 36 centimeters and a diameter of 30 millimeters. For the 22.5 weight percent dispersion, a pull rate of 100, 120, 140, and 160 millimeters/minute provided 20, 24, 30, and 36 micrometer thick single photoconductive insulating layers on the drums after drying. The thickness of the resulting dried layers was determined by capacitive measurements and by transmission electron microscopy.

EXAMPLE III

The above devices were electrically tested with a cyclic scanner set to obtain 100 charge-erase cycles immediately followed by an additional 100 cycles, sequences at 2 charge-erase cycles, and 1 charge-expose-erase cycle, wherein the light intensity was incrementally increased with cycling to produce a photoinduced discharge curve from which the photosensitivity was measured. The scanner was equipped with a single wire corotron (5 centimeters wide) set to deposit 100 nanocoulombs/$cm^2$ of charge on the surface of the drum devices. The devices of Examples I and II were first tested in the positive charging mode and then in the negative charging mode. The exposure light intensity was incrementally increased by means of regulating a series of neutral density filters, and the exposure wavelength was controlled by a band filter at 780+ or −5 nanometers. The exposure light source was 1,000 watt Xenon arc lamp white light source.

The drum was rotated at a speed of 61 rpm to produce a surface speed of 95.8 mm/second or a cycle time of 0.984 seconds. The entire xerographic simulation was accomplished in an environmentally controlled light tight chamber at ambient conditions (35 percent RH and 20° C.).

Photoinduced discharge characteristics (PIDC) curves at positive and negative charging modes of a 30 micrometer thick drum of Example I showed initial photosensitivities, dV/dX, of ~200 and 120 $Vcm_2$/ergs for positive and negative charging modes, respectively. The CE conformed to the relation of CE=0.0072×E (V/μm)+0.048, where CE is the collection efficiency and E is the electric field, from an electric field E of 10 to 35 V/μm, indicating a linear relationship for the CE to electric field. The values of α and β in the above relation in the CE were deduced as follows. The PIDC data of the single layer devices were first fitted to bi-cubic splines. The derivative of the fitted curve was then mathematically obtained from the spline fit as a function of the electric field, E. The CE was then calculated, using the known device thickness, its dielectric constant and the wavelength of the exposure used to obtain the PIDC. A linear fit was then made to the high field portion of the CE; the slope of this linear fit provided α(0.0072) while the vertical intercept gave β(0.048). The CE has also been considered at excitation wavelengths of 450 nanometers and 680 nanometers, and is believed to follow the relation of CE=0.0022×E (V/μm)+0.023 and CE=0.0059×E (V/μm)+0.041, respectively.

EXAMPLE IV

Photoinduced discharge characteristics (PIDC) curves at positive and negative charging modes of a 30 micrometer thick photoconductive drum of Example II showed initial photosensitivities, dV/dX, of ~200 and 120 $Vcm^2$/ergs for positive and negative charging modes, respectively. The devices exhibited an $E_{1/2}$ of 3.1 ergs/$cm^2$, a ten-fold improvement in contrast to a $E_{1/2}$ of 12.4 ergs/$cm^2$ of the member of Example IV of U.S. Ser. No. 09/302,524, filed Apr. 30, 1999 on a photoconductive imaging member comprised of a supporting substrate, and thereover a layer comprised of a photogenerator hydroxygallium component, a charge transport component, and an electron transport, and 2.2 ergs/$cm^2$ for positive and negative charging modes, respectively.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An imaging member possessing a collection efficiency proportional to an electric field, and which member is comprised of a first layer containing a photogenerating component and a mixture of a charge transport component and a polymeric binder, and wherein the charge transport component is comprised of a mixture of hole transport and electron transport components, wherein the weight ratio of photogenerating component/binder/charge transport/electron transport component is from about 1:45:25:15 to about 1:55:35:18.

2. An imaging member in accordance with claim 1 wherein the collection efficiency is proportional to an electric field at light with a wavelength of from about 350 to about 950 nanometers.

3. An imaging member in accordance with claim 1 wherein the weight ratio of the photogenerating component to charge transport component is from about 2:100 to about 5:100, and the collection efficiency is proportional to said electric field of from about 1 to about 50 V/μm of the imaging member at light of a wavelength of from about 780 nanometers.

4. An imaging member in accordance with claim 1 wherein said collection efficiency is proportional to the electric field at a xerographic process speed of about 40 mm/s to about 400 mm/s.

5. An imaging member in accordance with claim 1 wherein said collection efficiency is proportional to said electric field at a dark decay rate of about 1 V/s to about 2,000 V/s.

6. A method of imaging which comprises generating an electrostatic latent image on the imaging member of claim 5, developing the latent image, and transferring the developed electrostatic image to a suitable substrate.

7. An imaging member in accordance with claim 1 wherein said first layer is of a thickness of from about 5 to about 60 microns wherein the weight ratio of photogenerating component/binder/charge transport/electron transport component is from about 1:46:27:16 to about 1:50:40:17.

8. An imaging member in accordance with claim 1 wherein the amounts for each of said components in the first layer mixture is from about 0.5 weight percent to about 5 weight percent for the photogenerating component; from about 30 weight percent to about 50 weight percent for the charge transport component; and from about 5 weight percent to about 30 weight percent for the electron transport component; and which components are contained in from about 30 weight percent to about 50 weight percent of a polymer binder.

9. An imaging member in accordance with claim 1 wherein the thickness of said first layer is from about 10 to about 35 microns.

10. An imaging member in accordance with claim 1 wherein said binder is present in an amount of from about 50 to about 90 percent by weight, and wherein the total of all components of said photogenerating component, said charge transport component, said binder, and said electron transport component is about 100 percent.

11. An imaging member in accordance with claim 1 wherein said photogenerating component absorbs light of a wavelength of from about 370 to about 950 nanometers.

12. An imaging member in accordance with claim 1 further containing a supporting substrate comprised of a conductive metal.

13. An imaging member in accordance with claim 12 wherein the substrate is aluminum, aluminized polyethylene terephthalate organized polyethylene terephthalate.

14. An imaging member in accordance with claim 1 wherein the binder is selected from the group consisting of polyesters, polyvinyl butyrals, polycarbonates, polystyrene-b-polyvinyl pyridine, and polyvinyl formulas.

15. An imaging member in accordance with claim 1 wherein said hole transport component or components for said first layer and said second layer is comprised of molecules of the formula

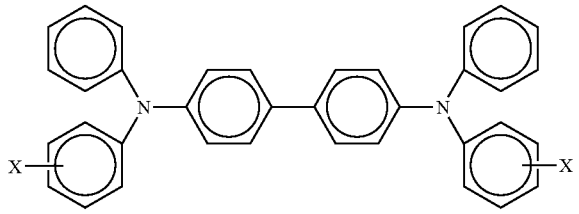

wherein X is selected from the group consisting of alkyl, alkoxy and halogen.

16. An imaging member in accordance with claim 15 wherein alkyl contains from about 1 to about 10 carbon atoms, and wherein the charge transport is an aryl amine encompassed by said formula and which amine is optionally dispersed in a resinous binder.

17. An imaging member in accordance with claim 15 wherein alkyl is methyl, and wherein halogen is chloride.

18. An imaging member in accordance with claim 15 wherein said hole transport is comprised of molecules of N,N'-diphenyl-N,N'-bis(3-methylphenyl)-1, 1 '-biphenyl-4, 4'-diamine.

19. An imaging member in accordance with claim 15 wherein said electron transport component is (4-n-butoxycarbonyl-9- fluorenylidene)malononitrile, 2-methylthioethyl 9-dicyanomethylenefluorene-4-. carboxylate, 2-(3-thienyl) ethyl 9dicyanomethylenefluorene-4-carboxylate, 2- phenylthioethyl 9-dicyanomethylene fluorene-4-carboxylate, 11,11,12,12- tetracyano anthraquinodimethane or 1,3-dimethyl-10-(dicyanomethylene)- anthrone.

20. An imaging member in accordance with claim 1 wherein said electron transport component is (4-n-butoxycarbonyl-9- fluorenylidene) malononitrile, 2-methylthioethyl 9-dicyanomethylenefluorene-4- carboxylate, 2-(3-thienyl)ethyl 9-dicyanomethylenefluorene-4-carboxylate, 2-phenylthioethyl 9-dicyanomethylene fluorene-4-carboxylate, 11,11,12,12- tetracyano anthraquinodimethane or 1 ,3-dimethyl-10-(dicyanomethylene)- anthrone.

21. An imaging member in accordance with claim 1 wherein said electron transport component is (4-n-butoxycarbonyl-9- fluorenylidene) malononitrile.

22. An imaging member in accordance with claim 1 further including a second photogenerating component of a titanyl phthalocyanine, a metal phthalocyanine other than titanyl phthalocyanine, a perylene, trigonal selenium, or mixtures thereof.

23. An imaging member in accordance with claim 1 wherein said electron transport is {4-n-butoxy carbonyl-9-fluorenylidene)malononitrile, and the charge transport is a hole transport of N,N'-diphenyl-N,N'-bis(3-methylphenyl)-1, 1 '-biphenyl-4,4'-diamine molecules.

24. An imaging member in accordance with claim 1 wherein said electron transport is selected from the group consisting of N,N'-bis(1 ,2-dimethylpropyl)-1,4,5 ,8-naphthalenetetracarboxylic diimide

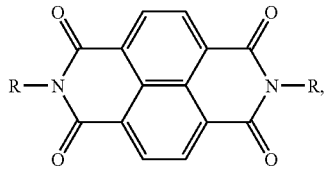

1,1 '-dioxo-2-(4-methylphenyl)-6-phenyl-4-(dicyanomethylidene) thiopyran

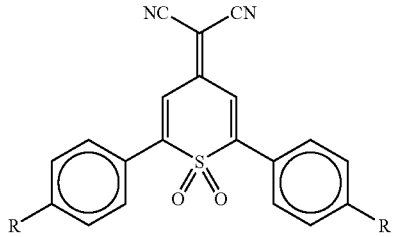

wherein R is independently selected from the group consisting of hydrogen, alkyl with 1 to about 4 carbon atoms, alkoxy with 1 to about 4 carbon atoms and halogen, and a quinone selected from the group consisting of carboxybenzylnaphthaquinone

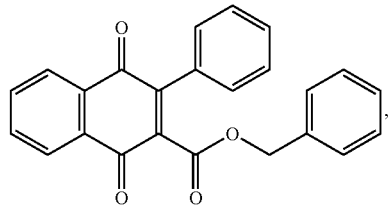

and tetra(t-butyl) diphenoiquinone

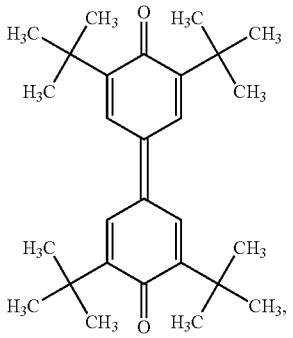

and mixtures thereof.

25. An imaging member in accordance with claim 1 wherein said binder is selected from the group consisting of polycarbonates, polystyrene-b-polyvinyl pyridine, N,N'-diphenyl-N,N'-bis(alkylphenyl)-1,1 -biphenyl-4,4'-diamine; TTA, tri-p-tolylamine; AE-18, N,N'-bis-(3,4,-dimethylphenyl)-4-biphenyl amine; AB-16, N, N'-bis-(4-methylphenyl)-N , N"-bis(4-ethylphenyl)-1 , 1 '-3,3'-dimethylbiphenyl)-4,4'-diamine; and PHN, phenanthrene diamine; and wherein the charge transport for said first layer and said second layer comprises aryl amine molecules of the formula

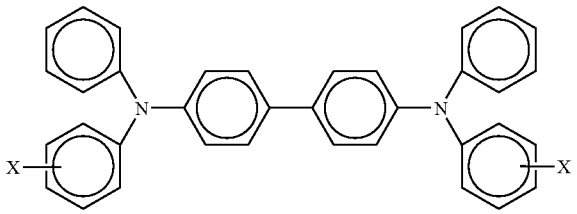

wherein X is selected from the group consisting of alkyl and halogen.

26. An imaging member possessing a collection efficiency proportional to an electric field, and which member is comprised of a first layer containing a photogenerating component and a mixture of a charge transport component and a polymeric binder, and wherein the charge transport component is comprised of a mixture of hole transport and electron transport components, wherein the amounts for each of said components in said first layer is from about 0.05 weight percent to about 30 weight percent for the photogenerating component, from about 10 weight percent to about 75 weight percent for the charge transport component, and from about 10 weight percent to about 75 weight percent for the electron transport component, and wherein the total of said components is about 100 percent, and wherein said layer components are dispersed in from about 10 weight percent to about 75 weight percent of said polymer binder, and wherein the weight ratio of photogenerating component/binder/charge transport/electron transport component is about 1.4:48.6:32:18.

27. A photoconductive imaging member comprised of a supporting substrate, and thereover a first layer comprised of a mixture of a photogenerator component, a charge transport component, an electron transport component, and a polymer binder, and wherein the weight ratio of photogenerating component/binder/charge transport/electron transport component is from about 1:45:25:15 to about 1:55:35:18. and thereover and in contact with said first layer a second layer wherein said second layer is comprised of a charge transport component and a resin binder.

28. A photoconductive imaging member in accordance with claim 27 wherein said photogenerating component is a metal free phthalocyanine.

29. A photoconductive imaging member in accordance with claim 27 wherein said charge transport component for said first and second layer is comprised of hole transport molecules.

* * * * *